US006729028B1

(12) United States Patent
Hsu

(10) Patent No.: US 6,729,028 B1
(45) Date of Patent: May 4, 2004

(54) STRUCTURE OF CUTTER KNIFE

(76) Inventor: Cheng-Hui Hsu, No. 126, Pao Chung Road, Hsin Tien City, Taipei Hsien (TW)

( * ) Notice: Subject to any disclaimer, the term of this patent is extended or adjusted under 35 U.S.C. 154(b) by 0 days.

(21) Appl. No.: 10/327,009

(22) Filed: Dec. 24, 2002

(51) Int. Cl.[7] ..... B25F 1/04
(52) U.S. Cl. ..... 30/143; 7/118
(58) Field of Search ..... 30/142, 143, 162, 30/335; 7/118

(56) References Cited

U.S. PATENT DOCUMENTS 6,330,749 B1 * 12/2001 Khachatoorian et al. ..... 30/162
6,374,497 B1 * 4/2002 Sun ..... 30/162
2003/0079294 A1 * 5/2003 Van Deursen et al. ..... 7/118

* cited by examiner

*Primary Examiner*—Hwei-Siu Payer
(74) *Attorney, Agent, or Firm*—Rosenberg, Klein & Lee

(57) ABSTRACT

The present invention discloses an improved structure of a cutter knife, comprising of a front casing, a rear casing, a front support pad, a rear support pad, a slider, a sliding bracket, a knife cartridge, a tail blade, a press button, a blade stopper, a stop block button and stopper button. Besides providing a convenient way of replacing the blades, the knife cartridge is capable of accommodating a plurality of spare blades, and the tail blade enhances the practicality and application of the cutter knife.

1 Claim, 7 Drawing Sheets

STRUCTURE OF CUTTER KNIFE

BACKGROUND OF THE INVENTION

1. Field of the Invention

The present invention relates to an improved structure of a cutter knife, more particularly to a cutter knife with a more secure and safer grip, comprising a front casing, a rear casing, a front support pad, a rear support pad, a slider, a knife cartridge, a tail blade, a press button, a blade stopper, a stop block button and stopper button. Besides providing a convenient way of replacing the blades, the knife cartridge is capable of accommodating a plurality of spare blades, and the tail blade enhances the practicality and application of the cutter knife.

2. Description of the Prior Art

In general, a traditional cutter knife has a sliding bracket and a single-sided wavy groove in the slider. Usually, these components are worn out, and reduce the latch function. Thus, the blade cannot be effectively fixed into the desired position, and also has the risk of causing slashes to users when the cutter knife is in use. Furthermore, the spare blades of the cutter knife are generally placed somewhere other than the knife itself. When the user needs to replace blades, it may take some find to locate the spare blades. In view of the existing shortcomings of the prior-art cutter knife, the inventor of the present invention with many years in the related field performing a series of researches and developments to enhance the cutter knife structure, and finally succeeds to invent the present invention.

SUMMARY OF THE INVENTION

The primary objective of the present invention is to provide an improved structure of a cutter knife, such that the cutter knife makes use of the smooth engagement of its slider and wavy stopping groove of the front casing to improve the latching effect and safety of the blade; furthermore, the knife cartridge of the present invention can accommodate a plurality of spare blades and integrate with the cutter knife as a whole to improve the convenience of replacing blades, and the tail knife also improves the practicality and application of the cutter knife.

To make it easier for our examiner to understand the objective of the invention, its structure, innovative features, and performance, we use a preferred embodiment together with the attached drawings for the detailed description of the invention.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
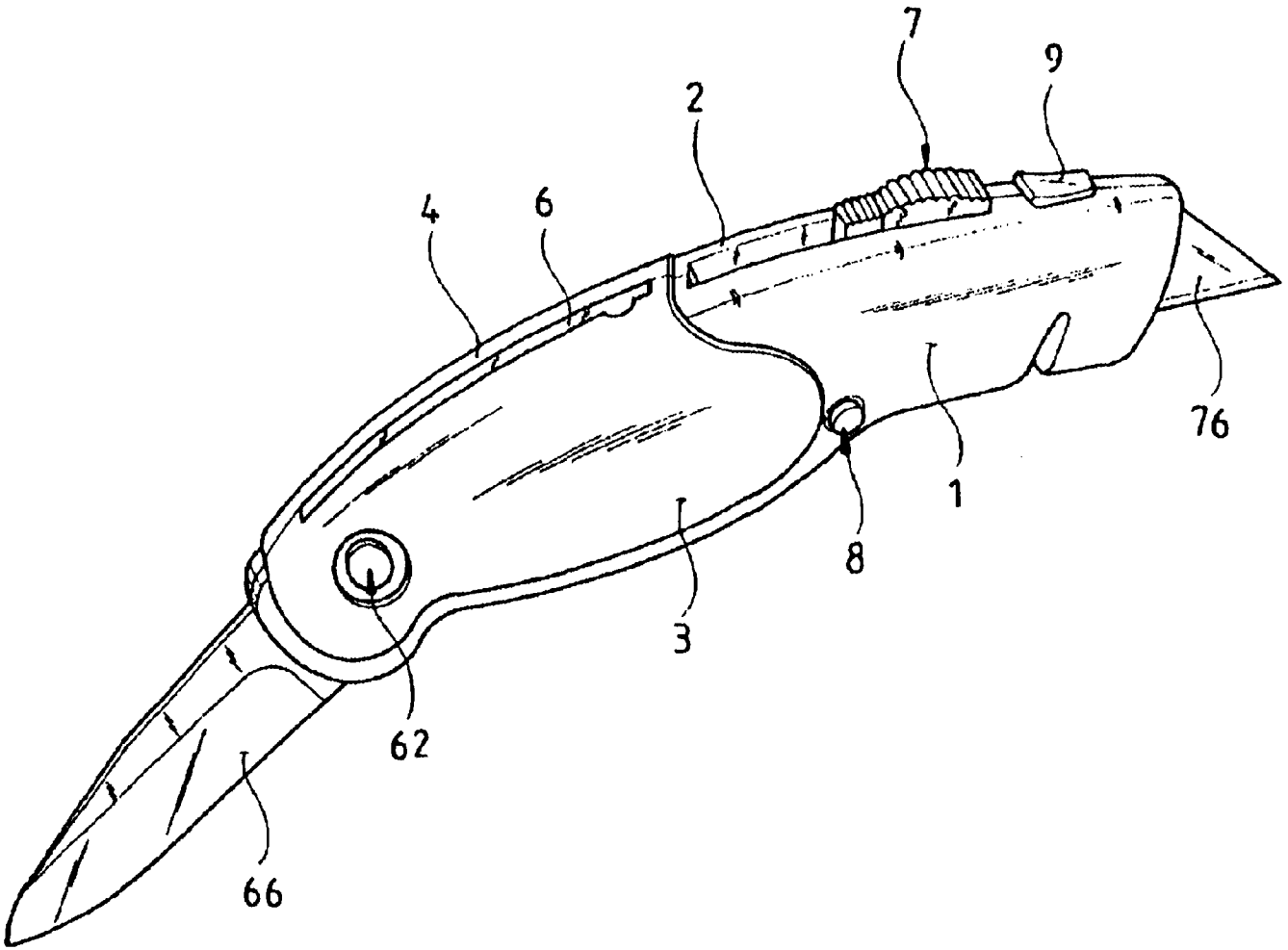
FIG. 1 is an illustrative diagram of the assembled structure of the present invention.
Figure 2:
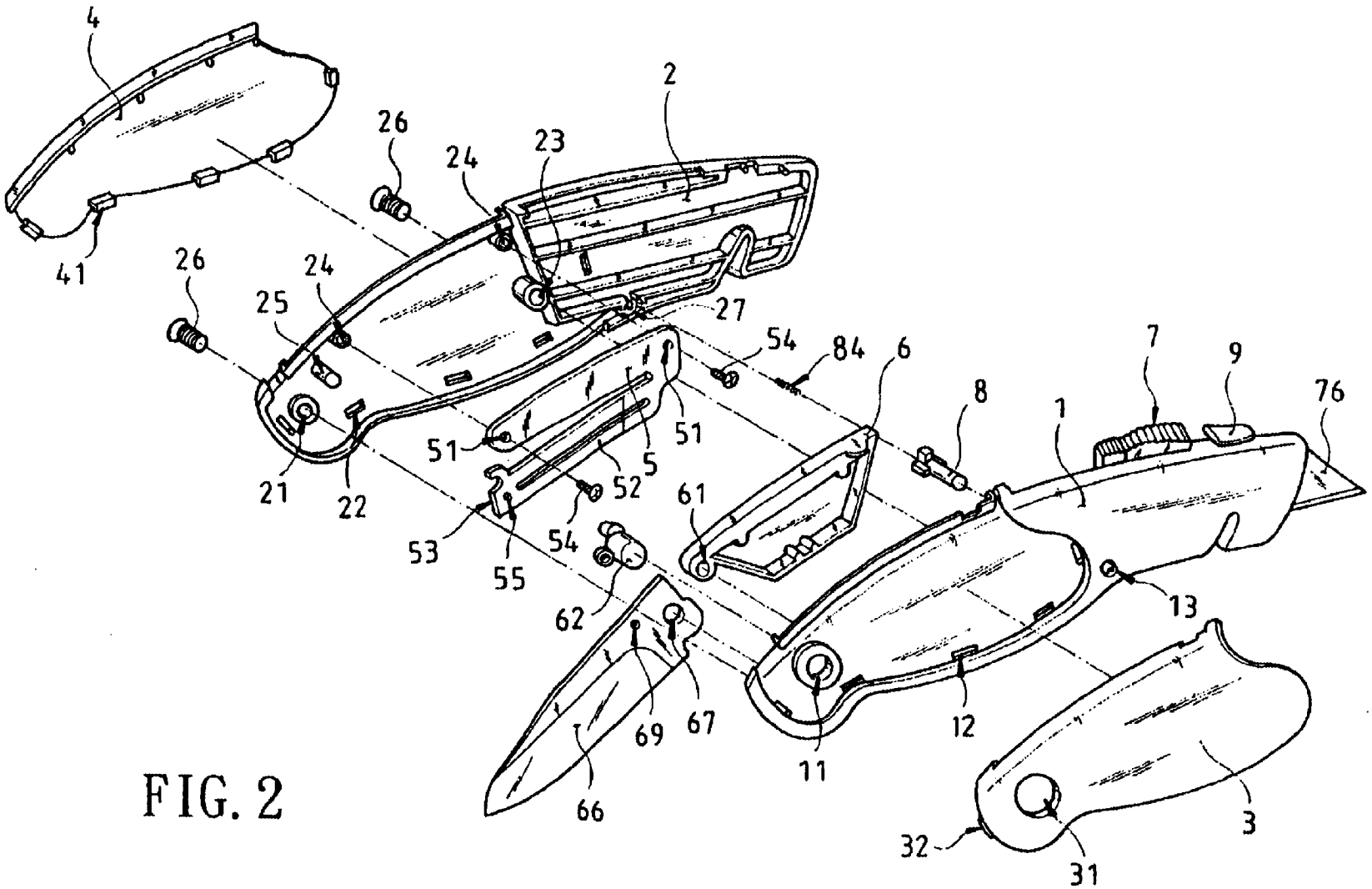
FIG. 2 and FIG. 3 are illustrative diagrams of the disassembled parts of the structure of the present invention.
Figure 3:
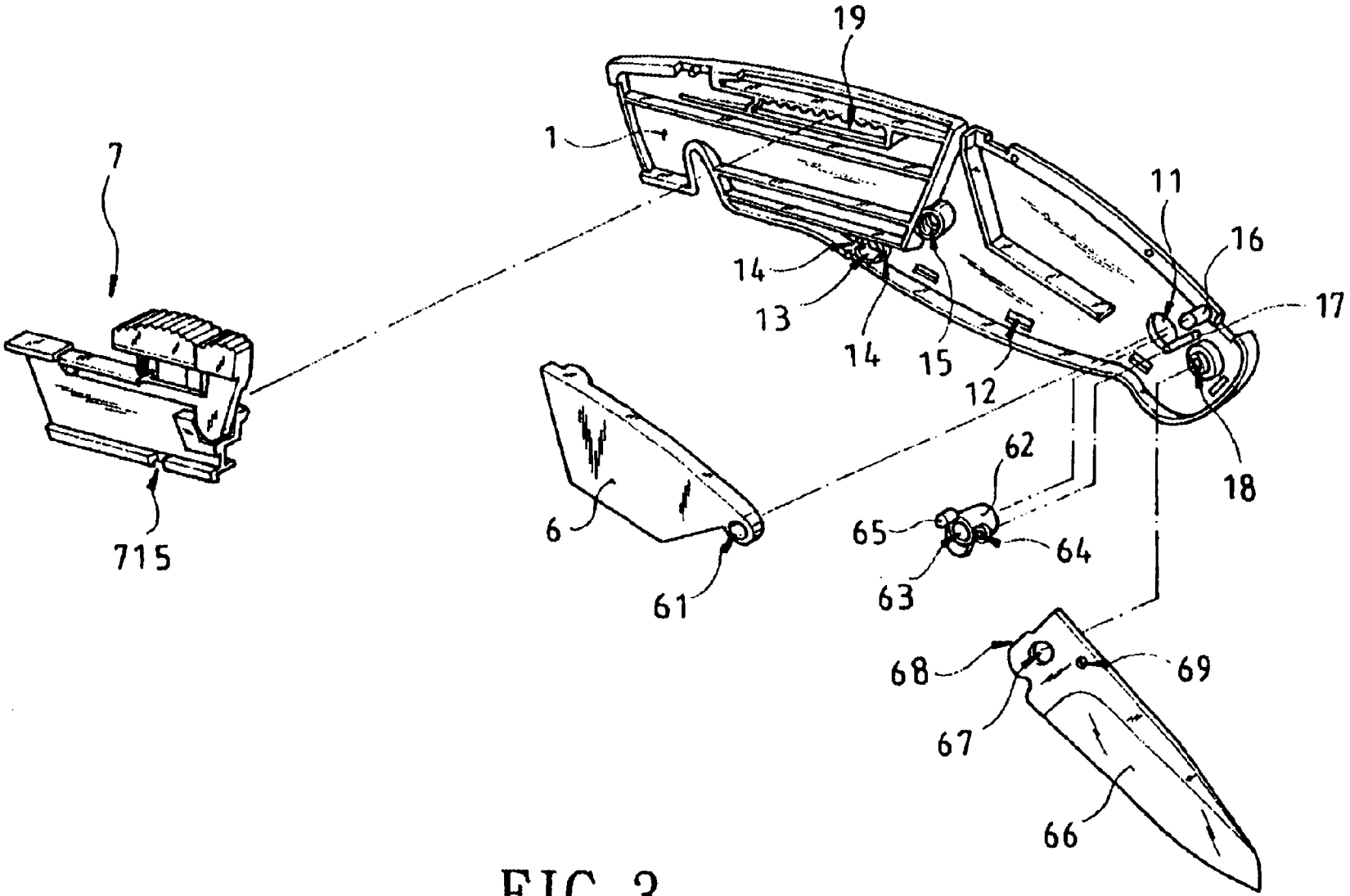
Figure 4:
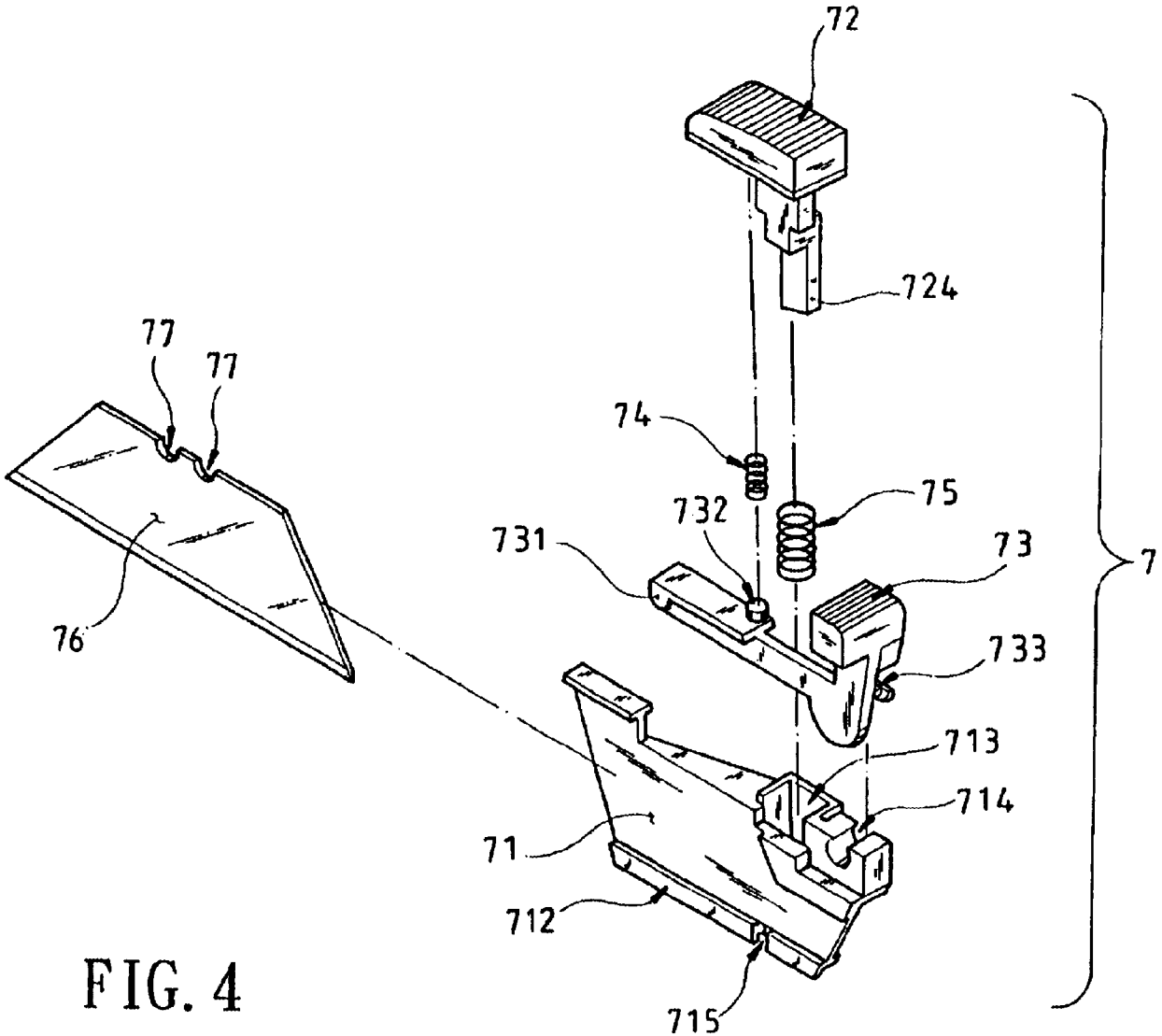
FIG. 4 is an illustrative diagram of the slider structure of the present invention.
Figure 5:
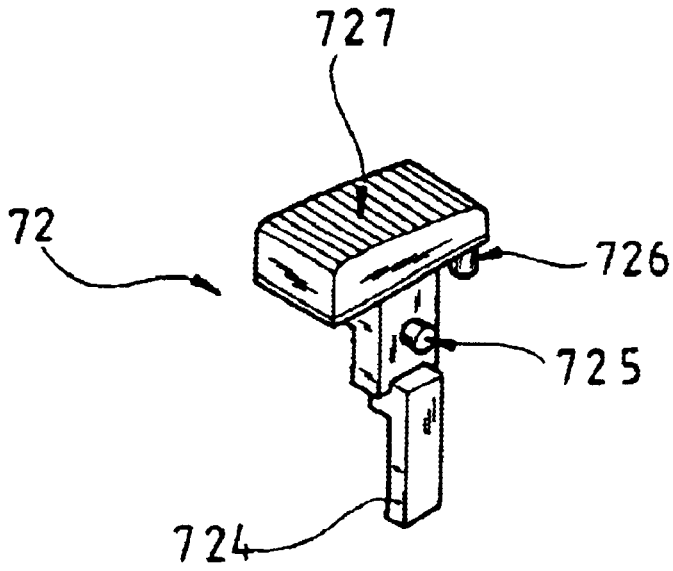
FIG. 5 to FIG. 8 are illustrative diagrams of the press button structure of the present invention.
Figure 6:
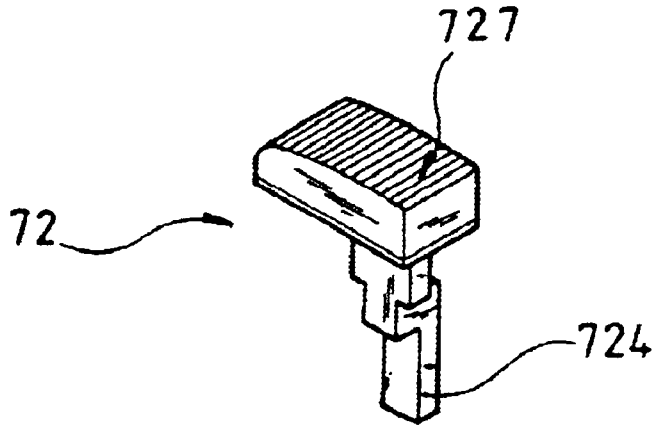
Figure 7:
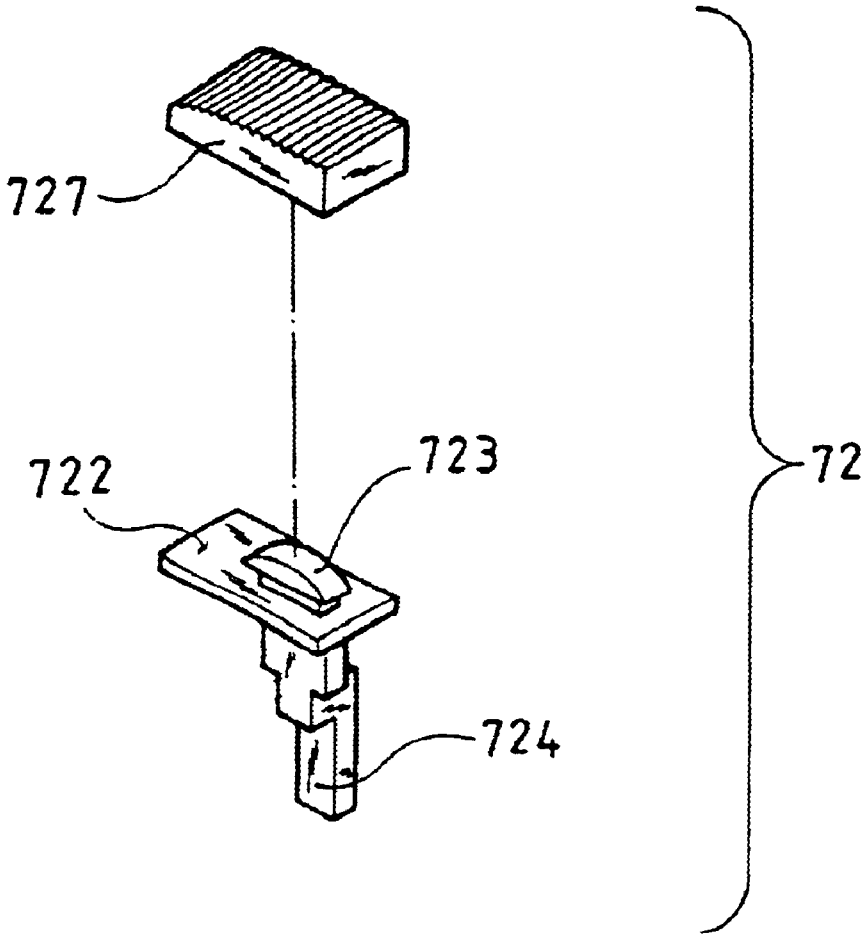
Figure 8:
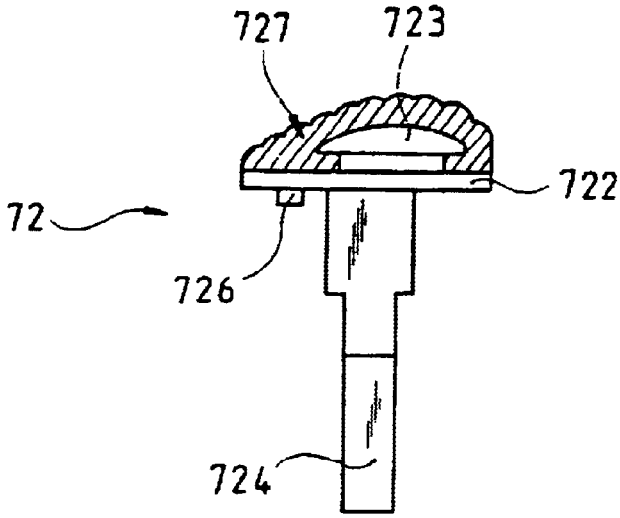
Figure 9:
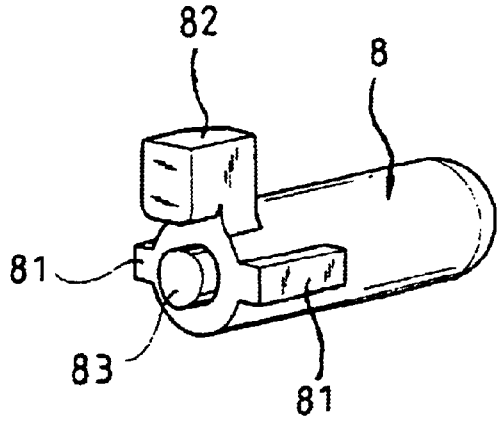
FIG. 9 is the illustrative diagrams of the stop block button structure of the present invention.

Please refer to FIG. 1 to FIG. 3. The improved structure of a cutter knife of the present invention comprises a front casing 1, a rear casing 2, a front support pad 3, a rear support pad 4, a slider 5, a knife cartridge 6, a tail blade 66, a press button 62, a blade stopper 7, a stop block button 8 and a stopper button 9; wherein:

the front casing 1, being an integral casing plate, having a circular groove 11 at the rear end of the front casing 1, and a plurality of latch holes 12 being disposed at the rear section of the front casing 1, and the front casing 1 at its middle section having a positioning hole 13, and the positioning hole 13 on both of its inner sides having a rectangular groove 14, furthermore the front casing 1 at the middle section of its inner side having a fixed screw hole 15, and the front casing 1 at the upper edge of the rear section of its inner side having a circular protruded axle 16, and the protruded axle 16 at its edge having a positioning sliding rod 17 with a diameter smaller than the protruded axle 16, and the front casing at the rear end of its inner side having a fixed screw hole 18 in the shape of a stairway-like rod, and the front casing 1 at the inner side of the upper edge of its front section having a wavy stop block groove 19;

the rear casing 2, being an integral casing plate, having a circular hole 21 at the rear end of the rear casing 2, and the rear casing 2 at its rear section having a plurality of latch holes 22, and the rear casing 2 at its middle section having a circular hole 23, and furthermore, the rear casing 2 at the inner side of the top at its rear end having a positioning axle 25 protruded inward, and the rear casing 2 at the bottom of its middle section having a fixed groove 27;

the front support pad 3, being integrally made of a soft plastic material, having a circular hole 31 disposed at its rear, and the front support pad 3 at the periphery of its inner side having a plurality of latch protrusion 32;

the rear support pad 4, being integrally made of a soft plastic material, having a plurality of latch protrusion 41 on the periphery of its inner side; the slider 5, being integrally bent and formed from a metal plate, having a circular hole 51 each on both sides of its upper edge, and furthermore, the slider 5 at its lower edge having an aslant bent plate 52, and the tail end of the aslant bent plate 52 at its inner side having a latch protrusion 55;

the knife cartridge, being an integral cartridge substantially in the shape of a hollow trapezoid casing, and an axle hole 61 at the top of its tail section;

the press button 62, being an integral hollow cylinder, having a circular hole groove 63 at the middle section of one of its sides, and the press button 62 at a side of its bottom having a sheath ring 64 protruded from a side of its bottom and a protruded pillar 65 on the other side;

the tail blade 66, having an axle hole 67 at the middle section of one of its end, and the tail blade 66 at its bottom having a vertical surface 68, and the tail blade 66 at the upper edge of its rear section having a through latch hole 69;

the blade stopper 7 (please refer to FIG. 4~FIG. 8), further comprising a blade base 71, a push button 72, and a blade replacing switch 73, wherein:

the push button 72 having a long rectangular embedding plate 722, and the embedding plate 722 at its middle section having an arc embedding member 723, and the push button 72 at its lower section having a vertical support pillar 724, and the push button 72 at a side of its middle section having a circular protruded pillar 725, and the embedding plate 722 at its front edge of the lower section having a protruded pillar 726, and the push button 72 having a soft lining 727 wrapped around its upper section;

the blade replacing switch 73, having a semicircular latch protrusion 731 at a side of the bottom edge of its front end, and the blade switching switch 73 at the middle section of its upper edge having a circular protruded pillar 732, and the blade switching button 73 at a side of its tail end having a support axle 733; the blade base 71, having a T-shaped embedding plate at the upper edge of its front end, and an embedding plate 712 at the lower edge, and the embedding plate 712 at its rear section having a latch groove 715, and the blade base 71 at its middle section having a rectangular hole groove 713, and furthermore the blade base 71 at the upper edge of the tail having a semicircular support axle hole 714;

the blade stopper 7 latching the support axle 733 at a side of its tail end into the semicircular support axle hole 714 at the upper edge of its end, and the push button 72 using the protruded pillar 726 and the protruded pillar 732 at the middle section of the blade replacing switch 73 sleeving and latching a spring 74, and the vertical pillar 724 at the lower section of the push button 72 sleeving and latching a spring 75, and then latching into the rectangular hole groove 713 of the blade base 71, and the blade 76 using the semicircular latch groove 77 of the blade 76 to embed and fix the latch protrusion 731 on a side of the bottom of the front end of the blade replacing switch to constitute a blade stopper 7;

the stop block button 8 (please refer to FIG. 9), being in the shape of a circular rod, having a rectangular support sliding member 81 each on both sides of one of its ends, and the stop block button 8 at the top of one of its ends having a rectangular latch protrusion 82, and furthermore, the stop block button at the middle section of its end having circular protruded pillar 83;

the present invention makes use of a protruded pillar 725 on a side of the push button 72 of the blade stopper 7 to latch and fix the inner side of the upper edge of the front section of the front casing 1 into the wavy stop block groove 19, and the stopper button 9 being latched to the upper edge of the front section of the front casing 1, and the stop block button 8 being disposed into the positioning hole 13 at the inner side of the middle section of the front casing 1, and the circular protruded pillar 83 at an end sleeving a spring 84, and the blade cartridge 6 latching the axle hole 61 to the protruded axle 16 at the upper edge of the rear section of the inner side of the front casing 1, and the press button 62 using a sheath ring 64 to sleeve the positioning sliding rod 17 at the rear section of the inner side of the front casing 1, and in the circular hole groove 11 at the rear end of the front casing 1 and the tail blade 66 using axle hole 67 at the end section to couple with the external stairway-like rod around the fixed screw hole 18 at the rear end of the inner side of the front casing 1; furthermore, the slider 5 using two screws 54 to couple the circular hole 51 on both sides of the upper edge and secure the screw hole 24 at the upper edge of the inner side of the rear section of the rear casing 2 with screws, such that the rear casing 2 and the front casing 1 being mutually aligned and engaged, and two screws 26 individually being secured into the circular holes 21, 23 on the rear casing 2 respectively, and the rear support pad 4 using the plurality of latch protrusions 41 on the periphery of the inner side to embed and attach the plurality of latch holes 22 at the rear section of the rear casing 2, and the front support pad 3 using the plurality of latch protrusions 32 to embed and attach the plurality of latch holes 12 at the rear section of the front casing 1 to constitute an integral structure of the cutter knife.

The protruded pillar 725 of the push button 72 of the present invention is latched and positioned in the wavy stop block groove 19 of the front casing 1. When a user presses the push button 72 down, the protruded pillar 725 separates the wavy stop block groove 19 and push the push button 72 outward such that the push button 72 together with the blade base 71, the blade replacing switch 73, and the blade 76 slide outward until the blade slides to an appropriate position, and then the push button 76 is released. The push button 72 uses the elasticity of the spring 74, 75 to bound back upward, and the protruded pillar 725 also latches into the wavy stop block groove 19 in order to accomplish the safe and reliable movement of the blade. If the user wants to draw the blade 76 back, then pushing the blade similarly in the reverse direction allows the user to draw back the blade 76.

If the user wants to replace the blade, the user just needs to press the blade replacing switch 73 down while the blade 76 of the cutter knife is being pushed outward, and the blade replacing switch 73 uses the support axle 733 as the axle center of the swing, so that the latch protrusion 731 at the front end of the blade replacing switch 73 is separated from and the latch groove 77 of the blade 76 to remove the blade 76. The new blade is then placed into the cutter knife, and then the blade switching switch is released, so that the blade replacing switch bases on the elasticity of the spring 74, 75 to drive the latch protrusion 731 to latch the blade 76 into the latch groove 77 to complete the blade replacement.

From the disclosure of the structure of the present invention as described above, the present invention definitely has the following merits:

1. The top of the push button 72 of the present invention is wrapped with a soft lining 727 to improve the comfort and stability of pushing the button by fingers.
2. The blade cartridge 6 of the present invention can accommodate a plurality of spare blades to provide a convenient way of replacing the blades for the users.
3. The tail blade 66 of the present invention improves the flexible effect on application, and the slider 5 having a latch surface 53 at the tail of its aslant bent plate 52 can prop against and latch the vertical surface at the bottom of the tail blade 66, so that the tail blade 66 can be used in a stable condition, and the tail blade 66 further has a latch hole. When the tail blade 66 is folded back into the cutter knife, the latch protrusion 55 of the slider 5 is used to latch and secure the tail blade 66 to improve the safety.
4. The stop block push button 8 and the latch protrusion 82 at the top of the stop block push button 8 of the present invention prop against latch into the latch groove 715 at the lower edge of the blade base 71, so that the blade stopper 7 keeps the blade 76 inside the cutter knife. Unless the user presses the stop block push button 8 inward to detach the latch protrusion 82 from the latch groove 715 of the blade base 71, and release the limitation and fixing of the slider 5, so that the slider can move the blade 76 back and forth, which provides a safe and protective structure.

In summation of the above description, the present invention herein enhances the performance than the conventional structure and further complies with the patent application requirements and is submitted to the Patent and Trademark Office for review and granting of the commensurate patent rights.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

What is claimed is:

1. An improved structure of cutter knife, comprising of a front casing, a rear casing, a front support pad, a rear support pad, a slider, a knife cartridge, a tail blade, a press button, a blade stopper, a stop block button, and a stopper button; wherein:

the front casing, being an integral casing plate, having a circular groove at the rear end of the front casing, and a plurality of latch holes being disposed at the rear section of the front casing, and the front casing at its middle section having a positioning hole, and the positioning hole on both of its inner sides having a rectangular groove, furthermore the front casing at the middle section of its inner side having a fixed screw hole, and the front casing at the upper edge of the rear section of its inner side having a circular protruded axle, and the protruded axle at its edge having a positioning sliding rod with a diameter smaller than the protruded axle, and the front casing at the rear end of its inner side having a fixed screw hole in the shape of a rod, and the front casing at the inner side of the upper edge of its front section having a wavy stop block groove;

the rear casing, being an integral casing plate, having a circular hole at the rear end of the rear casing, and the rear casing at its rear section having a plurality of latch holes, and the rear casing at its middle section having a circular hole, and furthermore, the rear casing at the inner side of the top at its rear end having a positioning axle protruded inward, and the rear casing at the bottom of its middle section having a fixed groove;

the front support pad, being integrally made of a soft plastic material, having a circular hole disposed at its rear, and the front support pad at the periphery of its inner side having a plurality of latch protrusions;

the rear support pad, being integrally made of a soft plastic material, having a plurality of latch protrusions on the periphery of its inner side;

the slider, being integrally bent and formed from a metal plate, having a circular hole each on both sides of its upper edge, and furthermore, the slider at its lower edge having an aslant bent plate, and the tail end of the aslant bent plate at its inner side having a latch protrusion;

the knife cartridge, being an integral cartridge substantially in the shape of a hollow trapezoid casing, and an axle hole at the top of its tail section;

the press button, being an integral hollow cylinder, having a circular hole groove at the middle section of one of its sides, and the press button at a side of its bottom having a sheath ring protruded from a side of its bottom and a protruded pillar on the other side;

the tail blade, having an axle hole at the middle section of one of its end, and the tail blade at its bottom having a vertical surface, and the tail blade at the upper edge of its rear section having a through latch hole;

the blade stopper further comprising a blade base, a push button, and a blade replacing switch, wherein:

the push button having a long rectangular embedding plate, and the embedding plate at its middle section having an arc embedding member, and the push button at its lower section having a vertical support pillar, and the push button at a side of its middle section having a circular protruded pillar, and the embedding plate at its front edge of the lower section having a protruded pillar, and the push button having a soft lining wrapped around its upper section;

the blade replacing switch, having a semicircular latch protrusion at a side of the bottom edge of its front end, and the blade switching switch at the middle section of its upper edge having a circular protruded pillar, and the blade switching button at a side of its tail end having a support axle;

the blade base, having a T-shaped embedding plate at the upper edge of its front end, and an embedding plate at the lower edge, and the embedding plate at its rear section having a latch groove, and the blade base at its middle section having a rectangular hole groove, and furthermore the blade base at the upper edge of the tail having a semicircular support axle hole;

the blade stopper latching a side of its tail to the support axle at the semicircular support axle hole at the upper edge of the tail of the blade base, and the push button using the protruded pillar thereof and the circular protruded pillar protruded from the middle section of the blade replacing switch sleeving and latching a spring, and furthermore the vertical support pillar at the lower section of the push button sleeving and latching a spring, and then latching into the rectangular hole groove of the blade base, and a blade using a semicircular latch groove of the blade to embed and fix the latch protrusion on a side of the bottom of the front end of the blade replacing switch to constitute a blade stopper;

the stop block button, being in the shape of a circular rod, having a rectangular support sliding member on each of both sides of its end, and the stop block button at the top of one of its ends having a rectangular latch protrusion, and furthermore, the stop block button at the middle section of its end having circular protruded pillar;

by means of the circular protruded pillar on a side of the push button of the blade stopper to latch and fix the inner side of the upper edge of the front section of the front casing into the wavy stop block groove, and the stopper button being latched to the upper edge of the front section of the front casing, and the stop block button being disposed into the positioning hole at the inner side of the middle section of the front casing, and the circular protruded pillar at an end sleeving a spring, and the blade cartridge latching the axle hole to the protruded axle at the upper edge of the rear section of the inner side of the front casing, and the press button using a sheath ring to sleeve the positioning sliding rod at the rear section of the inner side of the front casing, and in the circular groove at the rear end of the front casing and the tail blade using the axle hole at the end section to couple with the rod around the fixed screw hole at the rear end of the inner side of the front casing; furthermore, the slider using two screws to couple the circular hole on both sides of the upper edge therof and secure a screw hole at the upper edge of the inner side of the rear section of the rear casing with the screws, such that the rear casing and the front casing being mutually aligned and engaged, and two screws being individually secured into the circular holes on the rear casing respectively, and the rear support pad using the plurality of latch protrusions on the periphery of the inner side thereof to embed and attach the plurality of latch holes at the rear section of the rear casing, and the front support pad using the plurality of latch protrusions to embed and attach the plurality of latch holes at the rear section of the front casing to constitute an integral structure of the cutter knife.

* * * * *